US006792116B2

(12) United States Patent
Liu

(10) Patent No.: US 6,792,116 B2
(45) Date of Patent: Sep. 14, 2004

(54) EARPHONE WITH CONTROL DEVICE OF TIMING CALL SETTING

(76) Inventor: Min-Yi Liu, 12F-8, 888, Chingkuo Rd., Taoyuan (TW)

( * ) Notice: Subject to any disclaimer, the term of this patent is extended or adjusted under 35 U.S.C. 154(b) by 295 days.

(21) Appl. No.: 10/086,456

(22) Filed: Mar. 4, 2002

(65) Prior Publication Data

US 2003/0165243 A1 Sep. 4, 2003

(51) Int. Cl.[7] ..... H04R 1/10; G04B 47/00
(52) U.S. Cl. ..... 381/74; 368/12; 381/384
(58) Field of Search ..... 340/568.4, 686.1, 340/687, 686.4, 692, 384.71, 384.72, 384.73, 393.4; 381/74, 309, 26, 72, 370, 384; 181/129; 368/327, 10, 12

(56) References Cited

U.S. PATENT DOCUMENTS 4,821,247 A * 4/1989 Grooms ..... 368/63
4,982,642 A * 1/1991 Nishikawa et al. ..... 84/484
5,737,692 A * 4/1998 Lang ..... 455/66.1
5,751,825 A * 5/1998 Myers et al. ..... 381/118
5,894,455 A * 4/1999 Sikes ..... 368/12
6,008,720 A * 12/1999 Hongu et al. ..... 340/309.16

* cited by examiner

*Primary Examiner*—Xu Mei
(74) *Attorney, Agent, or Firm*—Rosenberg, Klein & Lee

(57) ABSTRACT

An earphone with control device of timing call setting, mainly comprises a earphone device with a plug body end and speaker end, a control circuit device that is disposed between the plug body end and speaker end of the earphone phone, as well as an external setting device. Control circuit comprises a timing setting circuit, time pulse circuit, sound generation circuit, sounds switch circuit and sound recording and broadcasting system. And, a timing setting can be done to the timing setting circuit through external setting device, when a set time is reached, the time pulse circuit outputs a time pulse to timing setting circuit, the sound generation circuit then emit an alarm sound to the sounds switch circuit, and the sounds switch circuit shuts off temporally the sound comes from the earphone device, and switches the alarm sound generated from the sound generation circuit to a speaker end of the earphone so as to reach the purpose of timing call.

10 Claims, 2 Drawing Sheets

EARPHONE WITH CONTROL DEVICE OF TIMING CALL SETTING

TECHNICAL FIELD

The present invention relates to an earphone with control device of timing call setting, and more particularly to an earphone, which has a control circuit device constructed by a timing setting circuit, time pulse circuit, sound generation circuit and sounds switch circuit, has a timing call function for a person when an earphone is in use on his head.

BACKGROUND OF THE PRESENT INVENTION

An earphone can be used broadly in stereo, walkman, radio, cellar phone, video game player, computer game and etc. to offer a better audio effect. But, a person indulges easily in his individual world and forgets to do his proper business or life when an earphone is worn on his head.

SUMMARY OF THE PRESENT INVENTION

An earphone with control device of timing call setting in the present invention mainly comprises a control circuit device constructed by a timing setting circuit, time pulse circuit, sound generation circuit, sounds switch circuit and sound recording and broadcasting system. And, a timing setting can be done to the timing setting circuit through external setting device, when a set time is reached, the time pulse circuit outputs a time pulse to the timing setting circuit, the sound generation circuit then emits an alarm sound to the sounds switch circuit, and the sounds switch circuit shuts off temporally the sounds coming from the earphone device, and switches the alarm sound generated from the sound generation circuit to a speaker end of the earphone so as to reach the purpose of timing call.

A main object of the present invention is to provide an earphone with control device of timing call setting, once the setting time is reached, Sound sources coming from the plug or go-between of the earphone can be switched off temporally and are switched to the alarm sound that is output from the control device, and the sounds generated from the control device can be sent to the earphone.

Additional objects, features and advantages of the invention will become apparent to those skilled in the art upon consideration of the following detailed description of preferred embodiments exemplifying the best mode of carrying out the invention as presently perceived.

BRIEF DESCRIPTION OF THE PRESENT INVENTION.

PREFERRED EMBODIMENT OF THE PRESENT INVENTION

Figure 1:
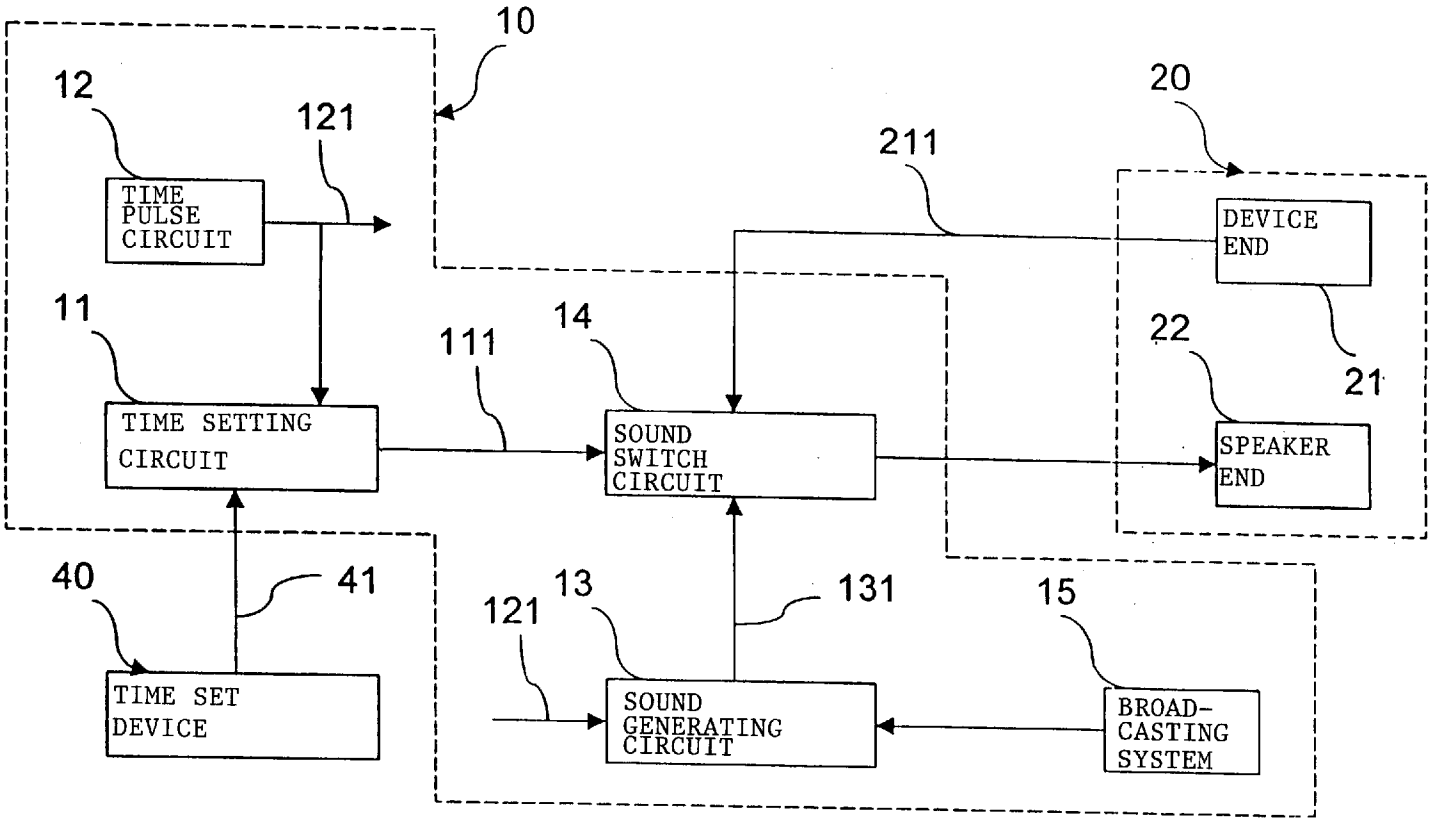
FIG. 1 is a block diagram of the present invention, showing relationship and functions of the circuits and elements.

Referring to FIG. 1, an earphone with control device of timing call setting of the present invention mainly comprises a control circuit device 10, the control circuit device consist of a time setting circuit 11, a time pulse circuit 12, a sound generating circuit 13, a sounds switch circuit 14. A timing setting 41 can be done to the timing setting circuit 11 by means of a external setting device 40, which can be a setting switch of button. When the setting time is reached, the time pulse circuit 12 output a time pulse 121 to the timing setting circuit 11, the timing setting circuit 11 output switch control signal 111 to the sound switch circuit 14, the sound switch circuit 14 switches off a sound source 211 comes from a device end 21 of the earphone 20 temporally first, then transmits an alarm sound 131 generated from the sound generating circuit 13 to a speaker end 22 of the earphone set 20 by means of the sounds switch circuit 14. After the alarm sound 131 is finished or the external setting device 40 is pressed down again, then the sound source 211 cones from the device end 21 of the earphone set 20 is recovered to output to the speaker end 22 of the earphone set 20.

The above-mentioned sound generating circuit 13 can also include a recording and broadcasting system 15, which can record a user's favorite alarm sound.

Furthermore, the timing setting circuit 11, time pulse circuit 12, sound generating circuit 13, sound switch circuit 14 and sound recording and broadcasting system 15 can be integrated wholly and partly by the way of complete software or part software and hardware technology so as to be miniaturized in structure, lower electricity consumption and reduce cost expenses, further, to simplify manufacturing complexity and upgrade product quality.

Figure 2:
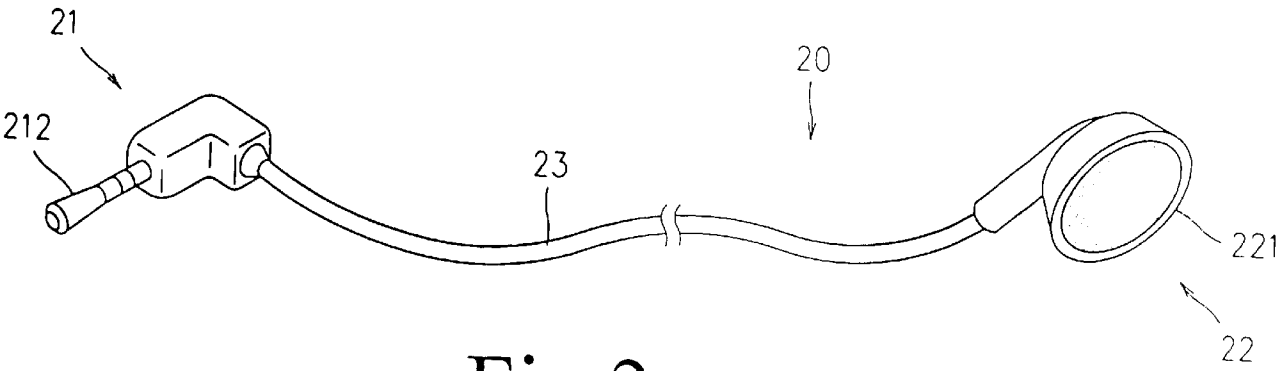
FIG. 2 is a perspective view of a preferred embodiment of the present invention, showing an outer profile of a wired earphone.

Summing from above, an earphone with control device of timing call setting of the present invention, mainly let the control circuit device 10 be installed between the plug body end 21 and speaker end 22 of the earphone 20. An wired earphone shown in FIG. 2, has a wire 23 disposed between the plug body end 22 and the speaker end 22, and a plug 212 that can be worn in a user's ears, disposed at the plug body end 22, positions that can be disposed for the control circuit device 10 are:

1. on the electric wire 23;
2. between the plug 212 and the electric wire 23;
3. in the earphone 221.

Figure 3:
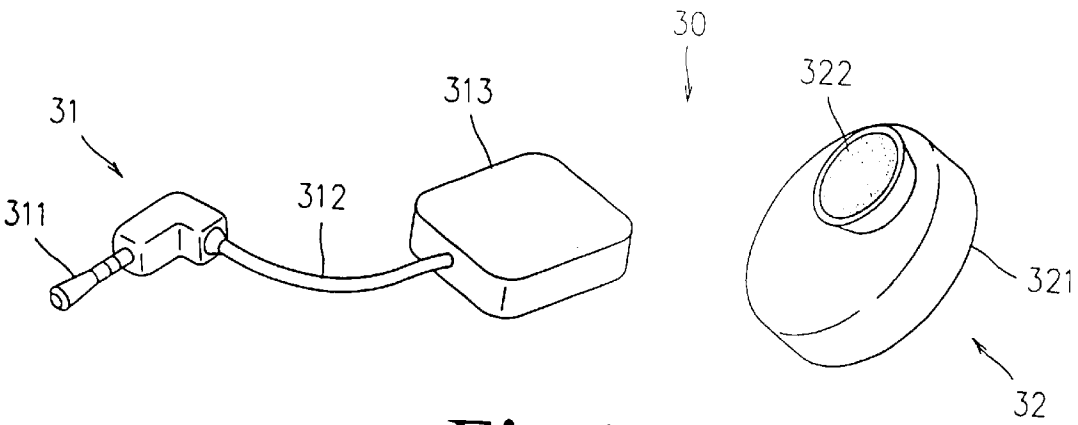
FIG. 3 is a perspective view of a preferred embodiment of the present invention, showing an outer profile of a wireless earphone.

Furthermore, referring to a wireless earphone shown in FIG. 3, it is wirelessly disposed between a plug body end 31 and speaker end 32 of an earphone set 30. The plug body end 31 has a plug 311 and transmitter device 313 therein connected by an electric wire 312, and the speaker end 32 has a receiver device 321 therein. Possible positions for the control circuit device 10 are:

1. on the electric wire 312;
2. in the transmitter device 313;
3. in the receiver device 321;
4. between the plug 311 and the electric wire 312;
5. in the earphone 322.

Thus, an earphone with control device of timing call setting of the present invention, has a timing call function and can record human voices and alarm sounds so as to mention a user an important matter of his proper business or life when an earphone is worn on his head.

The above disclosure is not intended as limiting. Those skilled in the art will readily observe that the numerous modifications and alternations of the device may be made while retaining the teachings of the invention. Accordingly, the above disclosure should be construed as limited only by the metes and bounds of the appended claims.

What is claimed is:

1. An earphone with control device of timing call setting, comprising:

an earphone device, comprising a plug body end and speaker end, a plug, utilized to be inserted in an output end of a stereo, being disposed at said plug body end, and said speaker end being utilized to wear in the ear of a user;

a control circuit device, disposed between said plug body end and said speaker end of said earphone device, comprising an external setting device;

said control setting circuit device also comprising:

a timing setting circuit, time pulse circuit, sound generating circuit, sound recording and transmitting system and sound switch circuit, a timing setting being able to be set on said timing setting circuit by means of said external setting device, when a setting time is reached, said time pulse circuit outputting a time pulse to said timing setting circuit, said timing setting circuit outputting a switch control signal to said sound switch circuit, and said sound switch circuit switching off sound source from said plug body end of said earphone set temporally first, then transmitting alarm sounds generate form said sound generating circuit to said speaker end of said earphone set through said sound switch circuit, after said alarm signal sounds are over or said external setting device is pressed again, recovering said sound source coming from said plug body end of said earphone set and outputting it to said speaker end of said earphone set.

2. The earphone of claim 1, wherein said control circuit device is formed in an integrated a semiconductor chip structure, said circuits and recording and transmitting system of said control circuit device being at least partially integrated in software.

3. The earphone of claim 1, wherein alarm sounds of said sound generating circuit can be generated according to time pulses and can also pair with a recording system to provide said alarm sounds therefrom.

4. The earphone of claim 1, an electric wire being disposed between said plug body end and speaker end of said earphone device, wherein said control circuit device is disposed on said electric wire.

5. The earphone of claim 1, an electric wire being disposed between said plug body end and speaker end of said earphone device, wherein said control circuit device is disposed between said plug of said plug body end and said electric wire.

6. The earphone of claim 1, an electric wire being disposed between said plug body end and speaker end of said earphone device, wherein said control circuit device is inserted in said earphone.

7. The earphone of claim 1, said earphone being wirelessly disposed between said plug body end and speaker end, a transmitter which is connected to said plug by a electric wire, being disposed at said plug body end, and a receiver device is disposed at said speaker end, wherein said control circuit device is disposed on said electric is disposed on said electric wire.

8. The earphone of claim 1, said earphone being wirelessly disposed between said plug body end and speaker end, a transmitter which is connected to said plug by a electric wire, being disposed at said plug body end, and a receiver device is disposed at said speaker end, wherein said control circuit device is disposed in said transmitter device.

9. The earphone of claim 1, said earphone being wirelessly disposed between said plug body end and speaker end, a transmitter which is connected to said plug by a electric wire, being disposed at said plug body end, and a receiver device is disposed at said speaker end, wherein said control circuit device is disposed in said receiver device.

10. The earphone of claim 1, said earphone being wirelessly disposed between said plug body end and speaker end, a transmitter which is connected to said plug by a electric wire, being disposed at said plug body end, and a receiver device and an earphone are disposed at said speaker end, wherein said control circuit device is inserted in said earphone.

* * * * *